US006948212B2

(12) United States Patent
Oh et al.

(10) Patent No.: US 6,948,212 B2
(45) Date of Patent: Sep. 27, 2005

(54) VACUUM CLEANER USABLE WITH CYCLONE AND POCKET-TYPE DUST COLLECTORS

(75) Inventors: Jang-keun Oh, Gwangju (KR); Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 305 days.

(21) Appl. No.: 10/277,332

(22) Filed: Oct. 22, 2002

(65) Prior Publication Data

US 2003/0221277 A1 Dec. 4, 2003

(30) Foreign Application Priority Data

May 31, 2002 (KR) ..... 2002-30723

(51) Int. Cl.[7] ..... A47L 9/16; A47L 9/14

(52) U.S. Cl. ..... 15/328; 15/350; 15/410; 55/DIG. 3; 55/429

(58) Field of Search ..... 15/328, 347, 350, 15/351, 410; 55/337, 372, 378, 429, 459.1, DIG. 3

(56) References Cited

U.S. PATENT DOCUMENTS

| | | | | |
|---|---|---|---|---|
| 5,228,169 A | * | 7/1993 | Stein et al. | 15/351 |
| 5,367,741 A | * | 11/1994 | Hampton et al. | 15/410 |
| 5,774,930 A | | 7/1998 | Sommer et al. | 15/326 |
| 5,779,745 A | | 7/1998 | Kilstrom | 55/337 |
| 5,935,279 A | | 8/1999 | Kilström | 55/337 |
| 6,334,233 B1 | * | 1/2002 | Roberts et al. | 15/410 |
| 2002/0184731 A1 | * | 12/2002 | Moine et al. | 15/352 |
| 2004/0216263 A1 | * | 11/2004 | Best et al. | 15/331 |

FOREIGN PATENT DOCUMENTS

| | | |
|---|---|---|
| DE | 10021594 | 5/2000 |
| DE | 10035253 | 7/2000 |
| DE | 10058314 | 11/2000 |
| DE | 10124216 | 5/2001 |
| GB | 2305623 | 4/1997 |
| GB | 2321181 | 7/1998 |
| WO | WO 0141619 | 6/2001 |
| WO | WO 0182767 | 11/2001 |

* cited by examiner

*Primary Examiner*—Theresa T. Snider
(74) *Attorney, Agent, or Firm*—Ladas & Parry LLP

(57) ABSTRACT

A vacuum cleaner with a single suction brush having a suction port contacting with a surface to be cleaned, and a vacuum generating device for generating a suction force at the suction port includes an air suction path connected by one end to the vacuum generating device of the suction brush, a dust collecting apparatus connected to the other end of the air suction path for separating and collecting dust and contaminants from an air drawn in through the air suction path, the dust collecting apparatus including: a cyclone-type dust collecting apparatus having a dust chamber of small capacity, causing the drawn air to whirl and thus separate the dust and contaminants from the air by centrifugal force generated by the whirling air, and a pocket-type dust collecting apparatus having a dust pocket of large capacity, and causing the drawn air to pass through the dust pocket, thereby filtering out dust and contaminants from the air, the cyclone-type dust collecting apparatus and the pocket-type dust collecting apparatus being alternately used in accordance with the characteristics of the space to be cleaned.

9 Claims, 7 Drawing Sheets

VACUUM CLEANER USABLE WITH CYCLONE AND POCKET-TYPE DUST COLLECTORS

BACKGROUND OF THE INVENTION

1. Field of the Invention

The present invention relates generally to a vacuum cleaner, and more particularly, to a vacuum cleaner capable of selectively using a pocket-type dust-collecting apparatus having a large capacity and a cyclone-type dust-collecting apparatus of a smaller capacity by sharing a single suction brush, i.e., by selectively connecting the pocket-type dust collecting apparatus and the cyclone-type dust collecting apparatus to the single suction brush.

2. Description of the Prior Art

Generally, a vacuum cleaner basically has a structure that draws dust-laden air from a surface to be cleaned by a suction force generated by a vacuum generating device, and separates and collects the dust entrained in the air in a dust collecting apparatus.

Vacuum cleaners are categorized in accordance with the principle or structure of their dust collecting process. For example, according to the structural categories, a vacuum cleaner may be categorized into an upright-type or canister type, and may be further categorized according to the categories of the dust collecting principle, for example, into a cyclone-type or pocket-type.

The cyclone-type vacuum cleaner separates dust from dust-laden air by centrifugal force, which is generated by whirling the dust-laden air, usually in a cyclone chamber. There is no need to use a disposable paper filter for separating dust, and the dust collector can be emptied whenever it is full of dust. Accordingly, the cyclone-type dust collecting apparatus has an advantage in terms of economic maintenance and repair costs.

A pocket-type vacuum cleaner, as it is referred to herein, has a filter or "dust pocket" made of a material that allows air to pass through the dust pocket but which also acts to filter dirt from dirt-laden air drawn through the pocket-type vacuum cleaner. Since pocket-type vacuum cleaners usually have a larger capacity dust pocket, than a cyclone-type vacuum cleaner, pocket-type vacuum cleaner are usually used in large areas, such as in the lodging business, including hotels. The cyclone-type vacuum cleaner has an advantage in that it can continuously clean an area without stopping for a replacement filter, however, a cyclone-type vacuum cleaner, has a smaller capacity compared with the pocket-type. Cyclone-type vacuum cleaners are typically used to clean smaller areas in places like a residence.

Depending on which type of dust collecting apparatus has to be used, the vacuum cleaner compatible with each type of dust collecting apparatus has to be separately maintained, and accordingly there has been much research and development regarding each type of vacuum cleaner.

Meanwhile, both cyclone-type and the pocket-type vacuum cleaners have a suction port directly contacting with the surface to be cleaned and a suction brush having a vacuum generating device. If a single vacuum cleaner can selectively use one or the other of the dust collecting apparatus having different capacities, e.g., the cyclone-type dust collecting apparatus and the pocket-type dust collecting apparatus, as necessary, by mounting each on the suction brush, both the manufacturer and user would benefit from such vacuum cleaner. That is, the manufacturer can save unnecessary expenditure in research and development for different types of vacuum cleaner, while the user can also save money as he/she would not required to buy different types of vacuum cleaner.

At present, there is no such vacuum cleaner being produced or even studied, while manufacturers or customers bear the high costs of having to purchase two types of vacuum cleaner if there are variable amounts of space to be cleaned.

SUMMARY OF THE INVENTION

Accordingly, it is an object of the present invention to provide a vacuum cleaner capable of selectively using a cyclone-type dust collecting apparatus and a pocket-type dust collecting apparatus by sharing a single suction brush, i.e, by selectively mounting the cyclone-type dust collecting apparatus and the pocket-type dust collecting apparatus on the suction brush.

The vacuum cleaner according to the present invention can selectively use the cyclone-type dust collecting apparatus and the pocket-type dust collecting apparatus according to the characteristics of a space to be cleaned, by mounting either the cyclone-type dust collecting apparatus or the pocket-type dust collecting apparatus on a single suction brush.

The above object is accomplished by a vacuum cleaner according to the present invention, including a single suction brush having a suction port contacting with a surface to be cleaned, and a vacuum generating device for generating a suction force at the suction port; an air suction path connected to one end to the vacuum generating device of the suction brush; a dust collecting apparatus connected to the other end of the air suction path, for separating and collecting dust and contaminants from an air drawn in through the air suction path, the dust collecting apparatus comprising: a cyclone-type dust collecting apparatus including a dust chamber having a small capacity, causing the drawn air to whirl and thus separate dust and contaminants from the air by centrifugal force generated by the whirling air, and a pocket-type dust collecting apparatus having a dust pocket of large capacity, causing the drawn air to pass through the dust pocket, thereby filtering out dust and contaminants from the air, the cyclone-type dust collecting apparatus or the pocket-type dust collecting apparatus being used alternately in accordance with the characteristics of the space to be cleaned.

Further provided is a fixing means provided to the suction brush, for removably securing either the cyclone-type dust collecting apparatus or the pocket-type dust collecting apparatus to the suction brush.

The fixing means includes a fixing member having a shape of a hollow pipe standing upright on the suction brush; and one or more fastening member perpendicularly passing through the fixing member.

The cyclone-type dust collecting apparatus includes a frame having a fixing portion formed on one end for being inserted in the fixing member, and a handle formed on the other end for a user's grip; a receiving member having a receiving portion of a predetermined capacity, and being connected to the frame; a cyclone body supported on the receiving member so as to be positioned on an upper side of the receiving portion, and having an inflow port and an outflow port connected to the air suction path, the cyclone body for forming the whirling air current from dust-laden air drawn in through the inflow port; a dust collecting chamber removably connected to a lower portion of the cyclone body for collecting dust and contaminants separated from the air by the whirling air current formed in the cyclone body; and a grill disposed at the outflow port of the cyclone body to prevent the separated dusts and contaminants from reverse flow through the outflow port, the grill having a plurality of passages interconnecting with the outflow port.

The cyclone-type dust collecting apparatus includes a fine dust collecting filter mounted on an upper portion of the cyclone body for collecting fine dust discharged together with the air through the outflow port; and a cover member removably connected to the upper side of the cyclone body to secure the fine dust collecting filter in a mounted position, the cover member defining an outflow passage interconnected with the outflow port.

The cyclone body comprises a first hooking hole formed on one upper side and a second hooking hole formed on another upper side, and the cover member comprises a hooking protrusion and a hook formed on locations corresponding to first and second hooking holes of the cyclone body, for supporting the cover member on the cyclone body in a removable manner.

The grill device comprises: a second square outflow port formed in the cover member; and a plurality of louvers pivotally formed on pairs of shafts which are formed on one and the other sidewalls of the second outflow port, the respective louvers pivoting on the shafts to open the second outflow port by the pressure of discharging air.

The shafts of the louvers are eccentrically formed, for enabling the louvers to be opened by the pressure of the discharging air and to be closed by their own weight.

Further provided is a restricting rib formed on at least one of the sidewalls of the second outflow port for restricting an opening angle of the louvers at a predetermined degree, and in a frontal direction from the view of a user.

The louvers are partially overlapped with each other, and having jaws formed at the overlapping areas so as to be closed in the same plane.

The pocket-type dust collecting apparatus comprises: a frame comprising a fixing portion formed on one end and inserted in the fixing member, and a handle formed on the other end for a user's grip; a connecting member connected to the frame, and comprising a connecting pipe connected to the air suction path; and a dust pocket supported on the connecting member, and comprising a connecting port formed on a rear side and connected to the connecting pipe, and a zipper formed on a front side.

BRIEF DESCRIPTION OF THE DRAWINGS

The above-mentioned objects and the features of the present invention will be more apparent by describing the preferred embodiment of the present invention in detail while referring to the appended drawings, in which.

DETAILED DESCRIPTION OF PREFERRED EMBODIMENTS

The present invention will be described in greater detail with reference to the accompanying drawings.

Figure 1:
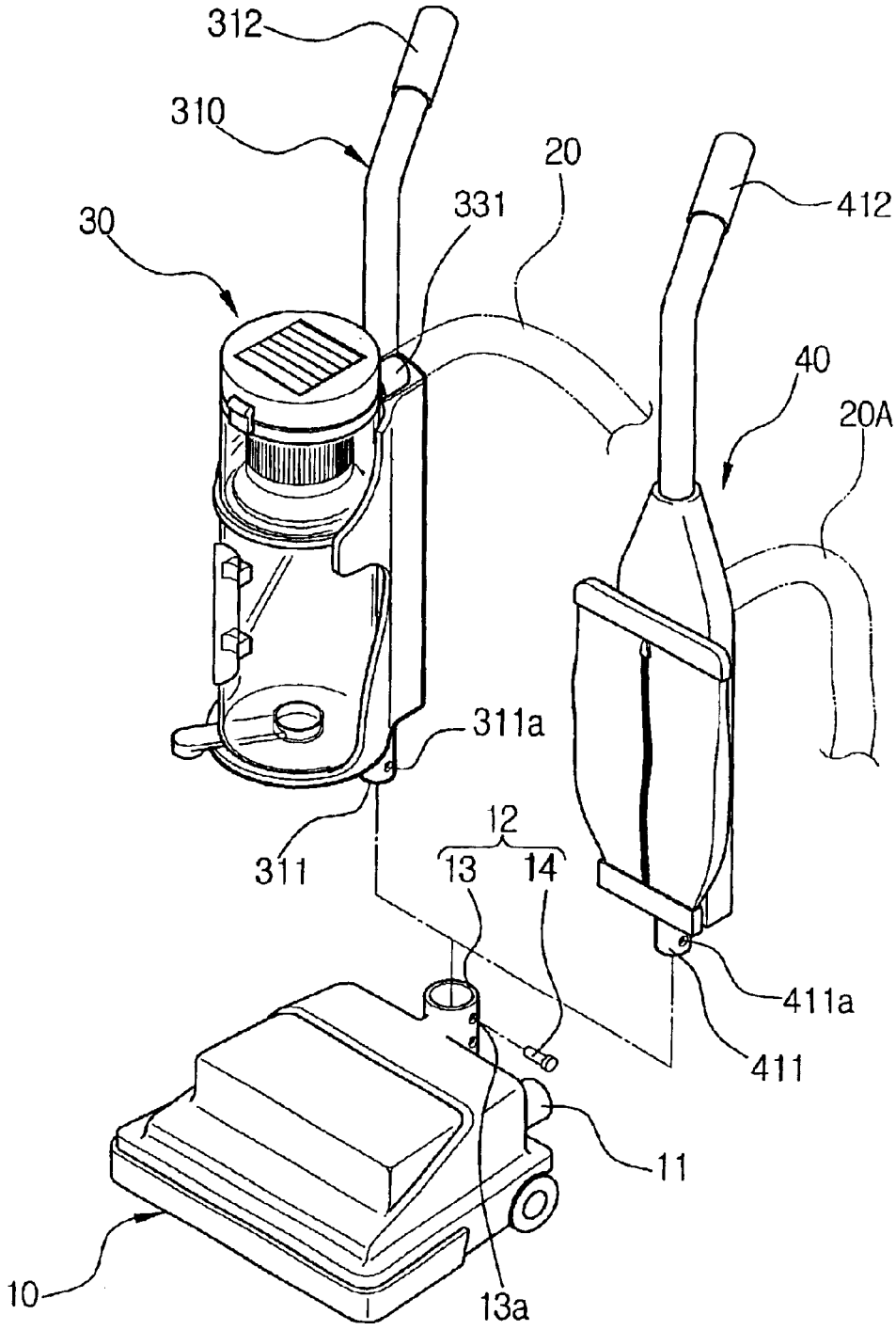
FIG. 1 is an exploded perspective view schematically showing a vacuum cleaner according to a preferred embodiment of the present invention capable of using either type of dust collecting apparatus.

FIG. 1 is an exploded perspective view schematically showing a vacuum cleaner according to a preferred embodiment of the present invention.

As shown in FIG. 1, the vacuum cleaner includes a single suction brush 10, an air suction path 20, and a cyclone-type dust collecting apparatus 30 and a pocket-type dust collecting apparatus 40 selectively mounted on the suction brush 10. The cyclone-type dust collecting apparatus 30 has a dust collecting chamber, and causes dust-laden air to whirl and thus separates dust from dust-laden air by centrifugal force generated from the whirling air. The pocket-type dust collecting apparatus 30 has a dust pocket of a capacity greater than the dust collecting chamber of the cyclone-type dust collecting apparatus 30 and separates the dust and contaminants from the dust-laden air by filtering the air. According to the present invention, the cyclone-type and pocket-type dust collecting apparatuses 30, 40 are selectively used in a single vacuum cleaner according to the size of an area to be cleaned by mounting either of the dust collecting apparatuses 30, 40 selectively on one suction brush 10.

Albeit not shown in detail, the suction brush 10 includes a suction port directly contacting with the surface to be cleaned, and a vacuum generating device for generating a suction force at the suction portion. The suction brush 10 also includes a connecting port 11 extending from the vacuum generating device to the outside. According to one aspect of the present invention, the suction brush 10 includes a fixing means 12 for removably fixing either the cyclone-type dust collecting apparatus 30 or the pocket-type dust collecting apparatus with the suction brush 10. The fixing means 12 includes a fixing member 13 in the shape of a hollow pipe which stands upright on a side of the suction brush 10, and one or more fastening members 14 perpendicularly passing through the fixing member 13. The fixing member 13 has a passing hole 13*a* formed therein to receive the fastening member. The number of passing hole 13*a* corresponds to the number of the fastening member 14.

Figure 6:
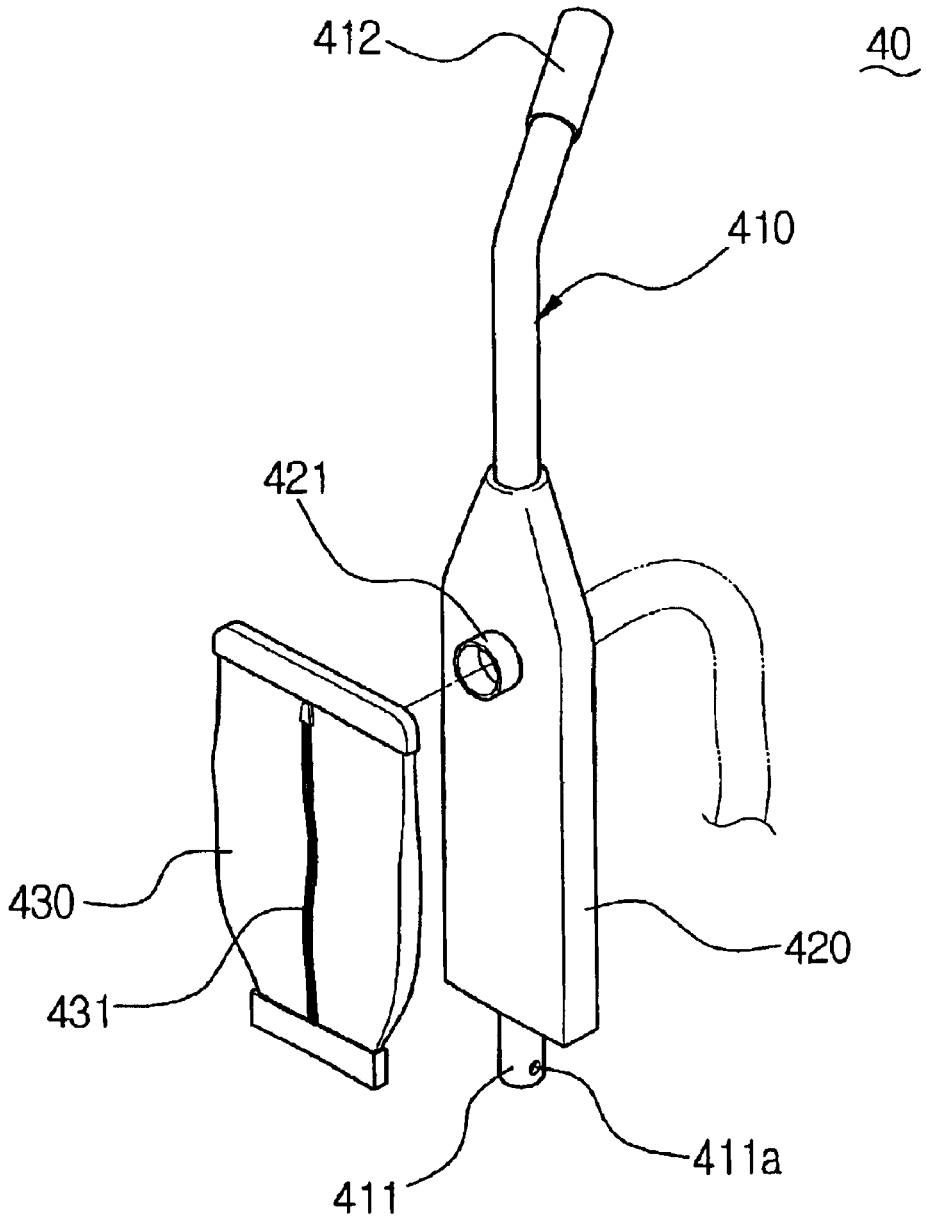
FIG. 6 is an exploded perspective view schematically showing a pocket-type dust collecting apparatus for use in the vacuum cleaner of FIG. 1.

The air suction path 20 is connected at one end to the connecting port 11 of the suction brush 10, and is connected at the other end either to an inflow port 331 of the cyclone-type dust collecting apparatus 30 or to a connecting pipe 421 of the pocket-type dust collecting apparatus 40 (see FIG. 6). Although this embodiment depicts two air suction paths 20, 20A provided to the cyclone-type dust collecting apparatus 30 and the pocket-type dust collecting apparatus 40, respectively, this should not be considered as limiting. For example, the cyclone-type and pocket-type dust collecting apparatuses 30, 40 can share one air suction path 20 connected to the suction brush 10.

Figure 2:
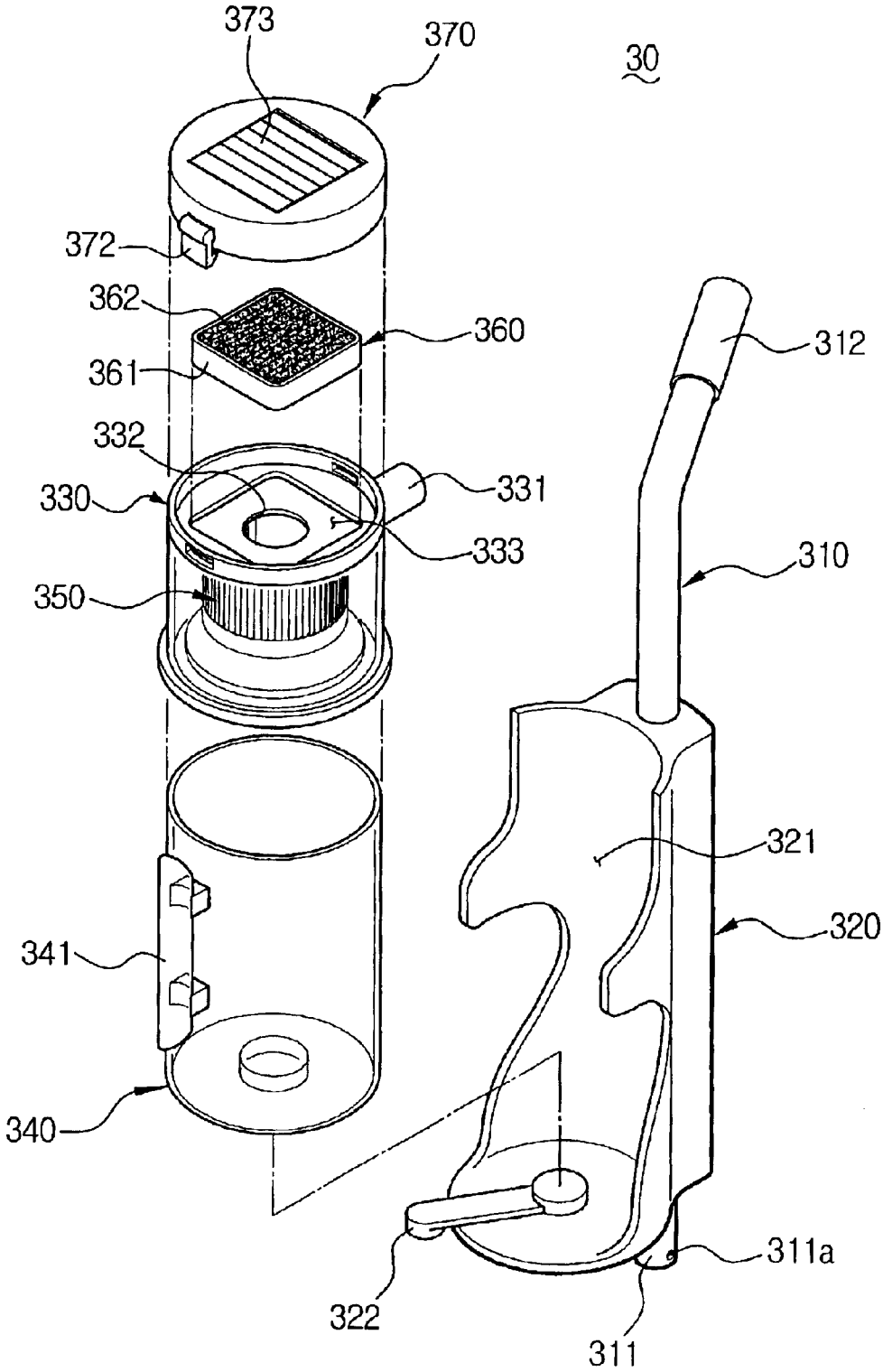
FIG. 2 is an exploded perspective view schematically showing a cyclone-type dust collecting apparatus for use in the vacuum cleaner of FIG. 1.
Figure 3:
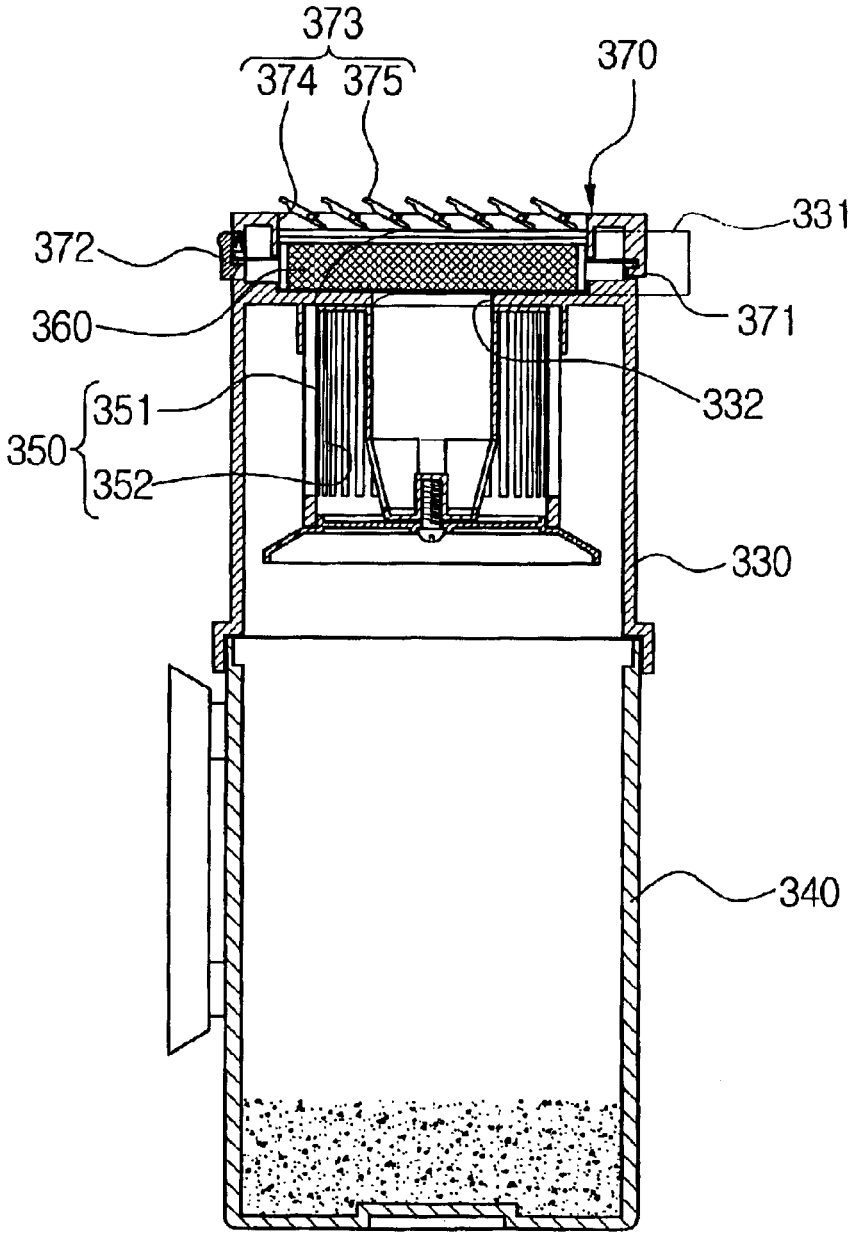
FIG. 3 is a sectional view showing the cyclone-type dust collecting apparatus of FIG. 2 after assembly.

As shown in FIGS. 2 and 3, the cyclone-type dust collecting apparatus 30 includes a frame 310, a receiving member 320, a cyclone body 330, a dust collecting chamber 340, a grill 350, a fine dust collecting filter 360 and a cover member 370.

The frame has a fixing portion 311 formed on a lower end for insertion into the fixing member 13 and a handle 312 formed on an upper end for providing a grip to the user. The fixing portion 311 has a second passing hole 311*a* corresponding to the passing hole 13*a* of the fixing member 13. Accordingly, the cyclone-type dust collecting apparatus 30 can be stably mounted on the suction brush 10 as the fastening member 14 is passed through the passing holes 13*a*, 311*a* with the fixing portion 311 being inserted in the fixing member 13. The cyclone-type dust collecting apparatus 30 can be easily removed from the suction brush 10 by unfastening the fastening member 14 from the passing holes 13*a*, 311*a*.

The receiving member 320 is connected with the frame 310, and includes a receiving portion 321 having a predetermined capacity. The frame 310 and the receiving member 320 are connected to each other by, for example, passing the frame 310 through the body of the receiving member 320 in an aperture disposed in the upper portion of the receiving member 320.

The cyclone body 330 is supported on the receiving member 320 such that it is positioned on the upper side of the receiving portion 321. The cyclone body 330 has an inflow port 331 and an outflow port 332 connected with the air suction path 20. The inflow port 331 is formed on a certain point of the side of the cyclone body 330, while the outflow port 332 is formed approximately at a center of the upper portion of the cyclone body 330. Dust-laden air is drawn in through the inflow port 331 and is guided into the cyclone body 330 in a diagonal direction, thus forming a whirling air current. By the centrifugal force generated from the whirling air current, dust is separated from the air, and the cleaned air is discharged out through the outflow port 332.

The dust collecting chamber 340 is removably mounted on a lower portion of the cyclone body 330 to receive and collect the dust separated from the air in the cyclone body 330. The dust collecting chamber 340 preferably includes a grip 341*to* provide convenience to the user. When the dust collecting chamber 340 is full of dust, the user can separate and empty the dust collecting chamber 340. Then the dust collecting chamber 340 is re-mounted and re-used. In FIG. 2, a lever 322 provides for an easy separation and mounting of the dust collecting chamber 340. When the dust collecting chamber is in its mounted position, the upper portion of the dust collecting chamber 340 stays in close contact with the lower portion of the cyclone body 330 due to the lever 322. The dust collecting chamber 340 can be easily separated from the cyclone body 330 by the lever 322.

The grill 350 is disposed at the outflow port 332 inside of the cyclone body 330, to prevent reverse flow of the dust and contaminants through the outflow port 332. The grill 350 has a grill body 351, and a plurality of passages 352 formed along the outer circumference of the grill body 351 to provide interconnecting fluid communication with the outflow port 332. The passages 352 are formed as fine holes so as to block large particle contaminants from passing therethrough. The blocked dust and contaminants are returned to the whirling air current of the cyclone body 330.

Meanwhile, dust-laden air often contains very fine dust. Such fine dust is usually not separated by the whirling air current, and thus is discharged through the passages 352 of the grill 350 and the outflow port 332 together with the air.

The fine dust collecting filter 360 is mounted on the upper portion of the cyclone body 330 to collect the fine dust, which may still be entrained in the air discharged through the outflow port 332. A seating portion 333 can be formed on the upper side of the cyclone body 330, for the fine dust collecting filter 360 to be seated thereon. The fine dust collecting filter 360 includes a square filter body 361 and a non-woven fabric disposed in the square filter body 361. Alternatively, the fine dust collecting filter 360 can be formed of a porous material, such as a sponge, etc.

The cover member 370 is removably connected with the upper side of the cyclone body 330 in order to secure the fine dust collecting filter 360 at the mounted position during the cleaning operation. Accordingly, the fine dust collecting filter 360 can filter the fine dust in a secured position. As the fine dust collecting filter 360 is removable, it is easy for a user to clean or repair the same.

Figure 4:
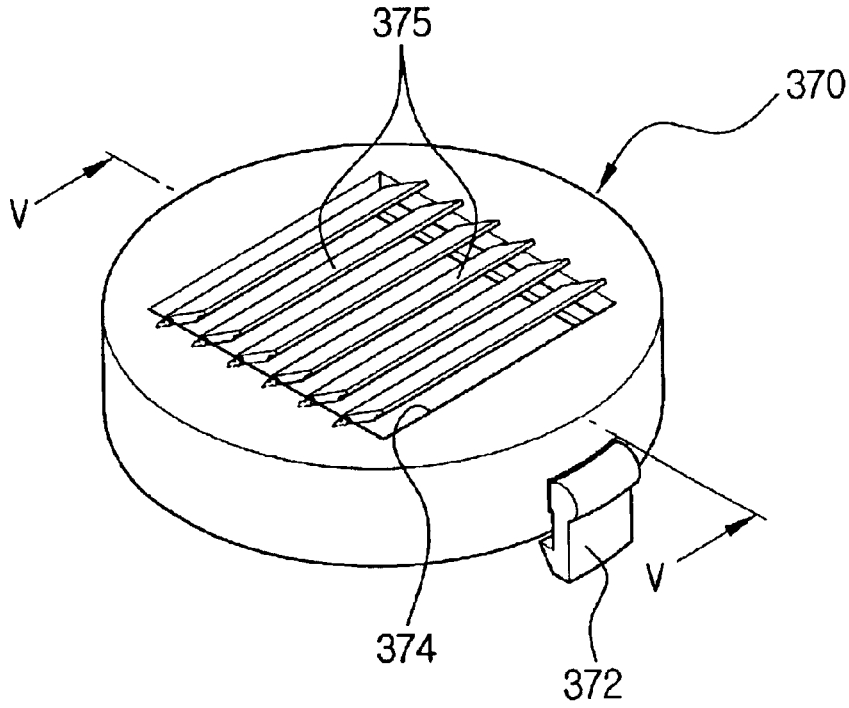
FIG. 4 is a perspective view showing a cover member of the cyclone-type dust collecting apparatus of FIG. 2.
Figure 5:
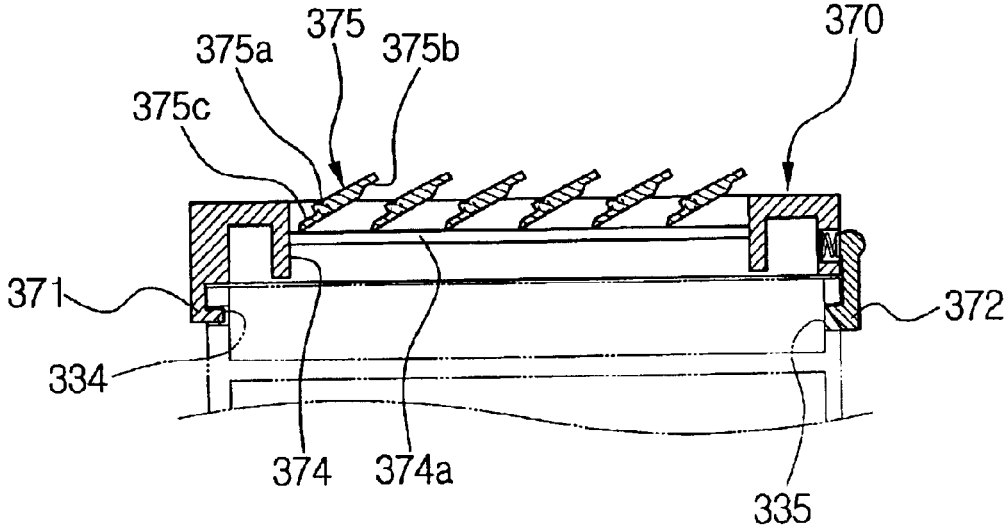
FIG. 5 is a sectional view of the cover member taken approximately along a line V—V of FIG. 4.

As shown in FIGS. 4 and 5, the cover member 370 has a hooking protrusion 371 formed on one side, and a hook 372 formed on the other side, while the cyclone body 330 has first and second hooking holes 334, 335 corresponding to the hooking protrusion 371 and the hook 372, for supporting the cover member 370 on the cyclone body 330 in cooperation with each other.

The cover member 370 includes a grill device 373 (FIG. 3) for defining an outflow passage interconnected with the outflow port 332. As shown in FIGS. 3 and 4, the grill device 373 has a second rectangular outflow port 374 formed on the cover member 370, and a plurality of louvers 375, pivotally formed on pairs of shafts 375*a* that are formed on opposed sidewalls of the second outflow port 374. The louvers 375 are pivoted by the pressure of the discharging air, thereby opening the second outflow port 374.

According to a preferred embodiment of the present invention, the shafts 375*a* are eccentrically positioned, so that the louvers 375 are opened by the pressure of the discharging air and closed by their own weight. Opening of the louvers 375 is provided during vacuum cleaner operation, while the closure of the louvers 375 means the cleaning operation is finished. In operation, the louvers 375 are opened by the pressure of the discharging air, and thereby forming the outflow passage. When the cleaning operation is finished, the louvers 375 are closed by their own weight, and therefore, there are no contaminants penetrating into the cyclone body after the cleaning operation is completed.

According to a more preferred embodiment of the present invention, as shown in FIG. 5, the second outflow port 374 has a restricting rib 374*a* extending along at least one sidewall, to restrict the opening angle of the louvers 375. As ends of the louvers 375 come in contact with the restricting rib 374*a*, the opening of the louvers 375 is limited to a certain degree. According to the present invention, the louvers 375 are opened approximately toward a frontal direction, thus the air is not discharged toward the user.

The louvers 375 are partially overlapped with each other, and each has jaws 375*b*, 375*c* formed on the overlapping portion, allowing the louvers 375 to be closed in the same line, that is, the surface when the louvers are closed in essentially the same plane.

As shown in FIG. 6, the pocket-type dust collecting apparatus 40 has a frame 410, a connecting member 420 and a dust pocket 430.

The frame 410 has a fixing portion 411 formed on a lower end for insertion into the fixing member 13, and a grip 412 formed on an upper end for a user's grip. The fixing portion 411 has a third passing hole 411*a* corresponding to the passing hole 13*a* of the fixing member 13. Accordingly, the pocket-type dust collecting apparatus 40 is stably mounted on the suction brush 10 by passing the fastening member 14 in the passing holes 13*a*, 411*a*, with the fixing portion 411 being inserted into the fixing member 13. The pocket-type dust collecting apparatus 40 can be separated from the suction brush 10 by unfastening the fastening member 14 from the passing holes 13*a*, 411*a*.

The connecting member 420 is connected with the frame 410, and the connecting member 420 has the connecting pipe 421 connected to the air suction path 20. The frame 410 and the connecting member 420 can be connected with each other, as in the case of the cyclone-type dust collecting apparatus 30, by passing the frame 410 through the body of the connecting member 420 in an aperture disposed in the upper portion of the connecting member 420.

The pocket 430 is supported on the connecting member 420. The pocket 430 has a connecting port (not shown) formed on a rear side for connection to the connecting pipe 421, and a zipper 431 formed on a front side for opening/closing the dust pocket 430. The dust pocket 430 can be made of porous material or cloth thereby permitting air to pass.

The operation of the vacuum cleaner constructed as above according to the present invention will be described with reference to FIGS. 7 and 8.

Figure 7:
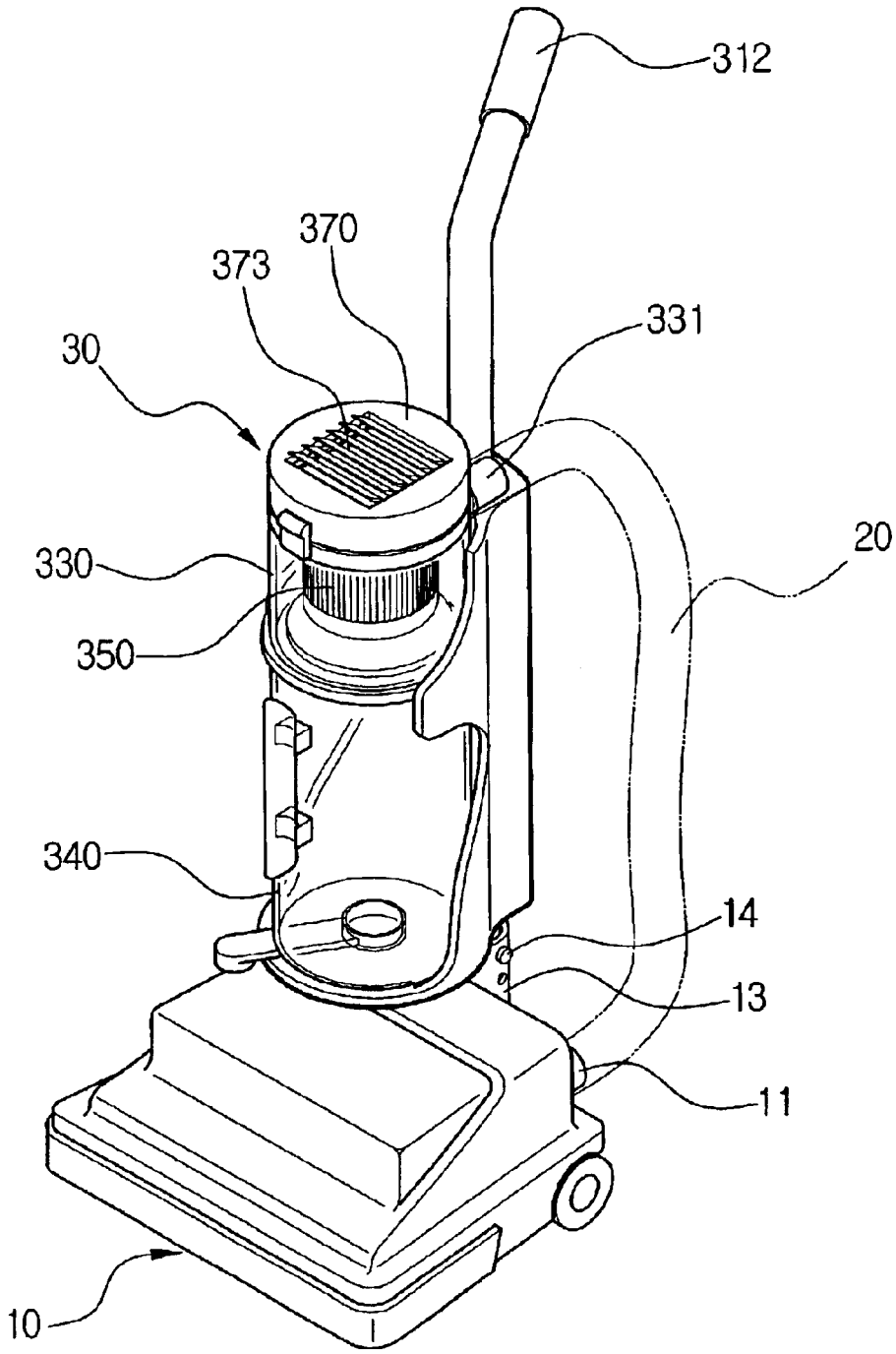
FIG. 7 is a perspective view showing the cyclone-type dust collecting apparatus being mounted on the suction brush of the vacuum cleaner according to the present invention.

FIG. 7 shows the cyclone-type dust collecting apparatus 30 being mounted on the suction brush 10. With the cyclone-type dust collecting apparatus 30 being mounted in the vacuum cleaner, the vacuum cleaner is used mainly for a small or middle-sized area, such as a house. In operation, the vacuum generating device is driven, and dust-laden air is drawn into the cleaner through the suction port (not shown) formed at a lower side of the suction brush 10 for directly contacting with the surface to be cleaned. The dust-laden air is drawn into the cyclone body 330 through the inflow port 331 in a diagonal direction, thereby forming a whirling air current. By the centrifugal force of the whirling air current, dust and contaminants are separated from the dust-laden air, and collected in the dust collecting chamber 340. The cleaned air is discharged out through the passages 352 (FIG. 3) of the grill 350, the outflow port 332, the fine dust collecting filter 360 and the grill device 373 of the cover member 370. Here, some fine dust may not be separated by the centrifugal force. These are, however, filtered by the fine dust collecting filter 360. As a result, clean air is discharged out of the cleaner.

Further, as the louvers 375 (FIG. 4) of the grill device 373 are opened by the pressure of the discharging air through the second outflow port 374 of the cover member 370, air discharge can be performed efficiently. From the view of the user, the louvers 375 are opened in a frontal direction, so that the user is not bothered by the air discharged toward him/her. After the cleaning operation, the louvers 375 are closed by their own weight, preventing possible penetration of foreign substances into the cyclone body 330.

Figure 8:
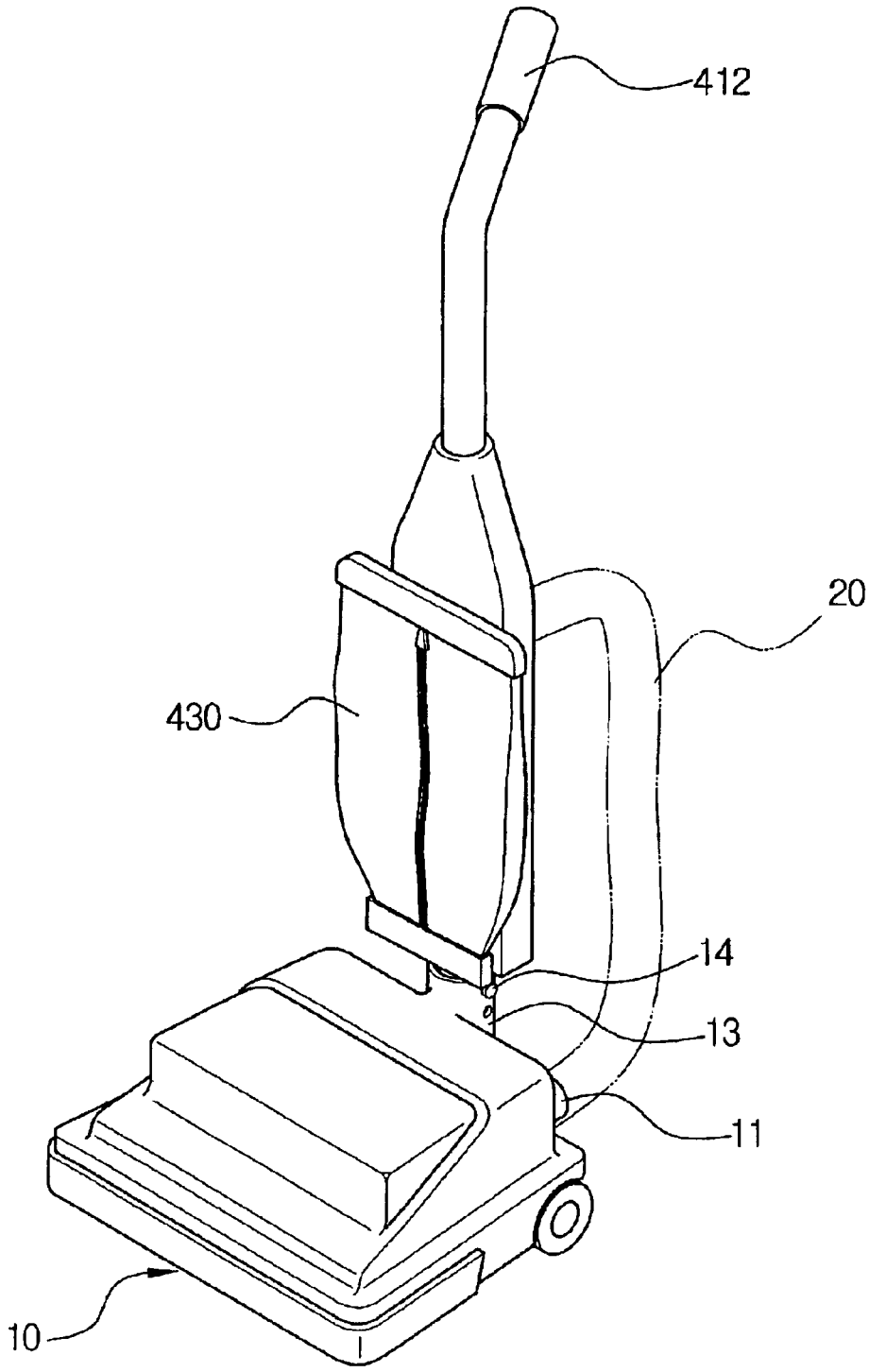
FIG. 8 is a perspective view showing the pocket-type dust collecting apparatus being mounted on the suction brush of the vacuum cleaner according to the present invention.

FIG. 8 shows the pocket-type dust collecting apparatus 40 being mounted on the suction brush 10 for the cleaning of large areas.

In operation, dust-laden air is drawn through the suction port of the suction brush 10, toward the dust pocket 430 via the air suction path 20 and the connecting pipe 421. As the dust pocket 430 is made of a material that enables passing of air, but not dust or contaminants, only the air is passed therethrough while dust is filtered out. The dust pocket 430 has a very large capacity for the purpose of cleaning large areas.

As described above, according to the present invention, both embodiments, that is, the cyclone-type apparatus 30 and the pocket-type dust collecting apparatus 40, can be selectively or alternately used in a single vacuum cleaner in accordance with the size of the space to be cleaned, by being mounted on a suction brush 10 of the vacuum cleaner. Manufacturers benefit because they can focus on a single vacuum cleaner model having two dust separation functions, as described above, instead of trying to develop several types of vacuum cleaner models for use of each function, thereby reducing costs and increasing quality. For the users, as there is no need to buy different types of vacuum cleaner for each function, and thereby the users can also save money.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A vacuum cleaner, comprising:

a single suction nozzle having a suction port contacting with a surface to be cleaned, a brush, and a vacuum generating device for generating a suction force at the suction port;

an air suction path connected to one end to the vacuum generating device of the suction brush;

a dust collecting apparatus connected to the other end of the air suction path, for separating and collecting dust and contaminants from air drawn in through the air suction path, the dust collecting apparatus comprising:

a cyclone-type dust collecting apparatus including a dust chamber having a first capacity, said cyclone-type dust collecting apparatus causing the drawn air to whirl and thus separate dust and contaminants from the air by centrifugal force generated by the whirling air, and a pocket-type dust collecting apparatus having a dust pocket of a second capacity, said pocket-type dust collecting apparatus causing the drawn air to pass through the dust pocket, thereby filtering out dust and contaminants from the air, the cyclone-type dust collecting apparatus or the pocket-type dust collecting apparatus being used alternatively in accordance with the characteristics of the space to be cleaned;

a fixing member provided to the suction brush having a shape of a hollow pipe standing upright on the suction nozzle, said fixing member removably securing either the cyclone-type dust collecting apparatus or the pocket-type dust collecting apparatus to the suction brush, as needed; and one or more fastening members perpendicularly passing through the fixing member.

2. The vacuum cleaner of claim 1, wherein the cyclone-type dust collecting apparatus comprises:

a frame having a fixing portion formed on one end for being inserted in the fixing member, and a handle formed on the other end for a user's grip;

a receiving member having a receiving portion of a predetermined capacity, and being connected to the frame;

a cyclone body supported on the receiving member so as to be positioned on an upper side of the receiving portion, and having an inflow port and an outflow port connected to the air suction path, the cyclone body for forming the whirling air current from dust-laden air drawn in through the inflow port;

a dust collecting chamber removably connected to a lower portion of the cyclone body for collecting dust and contaminants separated from the air by the whirling air current formed in the cyclone body; and a grill disposed at the outflow port of the cyclone body to prevent the separated dust and contaminants from reverse flow through the outflow port, the grill having a plurality of passages interconnecting with the outflow port.

3. The vacuum cleaner of claim 2, wherein the cyclone-type dust collecting apparatus further comprises:

a fine dust collecting filter mounted on an upper portion of the cyclone body for collecting fine dust discharged together with the air through the outflow port; and a cover member removably connected to the upper side of the cyclone body to secure the fine dust collecting filter in a mounted position, the cover member defining an outflow passage interconnected with the outflow port.

4. The vacuum cleaner of claim 3, wherein the cyclone body comprises a first hooking hole formed on one upper side and a second hooking hole formed on another upper side, and the cover member comprises a hooking protrusion and a hook formed on locations corresponding to first and second hooking holes of the cyclone body, for supporting the cover member on the cyclone body in a removable manner.

5. The vacuum cleaner of claim 3, wherein the grill device comprises:

a second square outflow port formed in the cover member, said second square outflow port having first and second opposing sidewalls; and a plurality of louvers pivotally formed on pairs of shafts which are formed on the first and second opposing sidewalls of the second square outflow port, the respective louvers pivoting on the shafts to open the second square outflow port by the pressure of discharging air.

6. The vacuum cleaner of claim 5, wherein the shafts of the louvers are eccentrically formed, for enabling the louvers to be opened by the pressure of the discharging air and to be closed by their own weight.

7. The vacuum cleaner of claim 6, further comprising a restricting rib formed on at least one of the opposing sidewalls of the second square outflow port for restricting an opening angle of the louvers at a predetermined degree, and in a frontal direction from the view of a user.

8. The vacuum cleaner of claim 5, wherein the louvers are partially overlapped with each other, and having jaws formed at the overlapping areas so as to be closed in the same plane.

9. The vacuum cleaner of claim 1, wherein the pocket-type dust collecting apparatus comprises: a frame comprising a fixing portion formed on one end and inserted in the fixing member, and a handle formed on the other end for a user's grip; a connecting member connected to the frame, and comprising a connecting pipe connected to the air suction path; and a dust pocket supported on the connecting member, and comprising a connecting port formed on a rear side and connected to the connecting pipe, and a zipper formed on a front side.

* * * * *